US008485573B2

(12) United States Patent
Gouhara et al.

(10) Patent No.: US 8,485,573 B2
(45) Date of Patent: Jul. 16, 2013

(54) HANDLE DEVICE FOR VEHICLE DOOR

(75) Inventors: Hiroshi Gouhara, Miyazaki (JP); Akinori Hidaka, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 333 days.

(21) Appl. No.: 12/829,939

(22) Filed: Jul. 2, 2010

(65) Prior Publication Data

US 2011/0080010 A1 Apr. 7, 2011

(30) Foreign Application Priority Data

Oct. 7, 2009 (JP) ..... 2009-233260

(51) Int. Cl.
*E05B 3/00* (2006.01)
*E05C 19/00* (2006.01)
*E05C 19/06* (2006.01)

(52) U.S. Cl.
USPC ..... 292/336.3; 292/1; 292/80; 292/DIG. 27; 292/DIG. 53; 292/DIG. 54

(58) Field of Classification Search
CPC ..... E05B 65/006; E05B 85/16; E05B 47/0012; E05C 19/06
USPC ..... 292/336.3, 1, 80, 81, 87, 88, DIG. 27, 292/DIG. 53, DIG. 54, DIG. 64, DIG. 38
See application file for complete search history.

(56) References Cited

U.S. PATENT DOCUMENTS

| | | | | |
|---|---|---|---|---|
| 4,038,718 | A * | 8/1977 | Reilhac et al. | 292/336.3 |
| 4,343,501 | A * | 8/1982 | Meeks | 292/336.3 |
| 6,059,329 | A * | 5/2000 | Spitzley | 292/336.3 |
| 6,067,869 | A * | 5/2000 | Chilla et al. | 74/96 |
| 6,070,923 | A * | 6/2000 | Tanimoto et al. | 292/336.3 |
| 6,099,052 | A * | 8/2000 | Spitzley | 292/336.3 |
| 6,241,294 | B1 * | 6/2001 | Young et al. | 292/336.3 |
| 2010/0276949 | A1 * | 11/2010 | Chang et al. | 292/336.3 |
| 2011/0080010 | A1 * | 4/2011 | Gouhara et al. | 292/336.3 |

FOREIGN PATENT DOCUMENTS

| | | | |
|---|---|---|---|
| JP | 61-160314 U | | 10/1986 |
| JP | 8-021423 A | | 1/1996 |
| JP | 9-078897 A | | 3/1997 |
| JP | 9078897 | * | 3/1997 |
| JP | 3069615 U | | 3/2000 |

* cited by examiner

*Primary Examiner* — Carlos Ngo
*Assistant Examiner* — Nathan Cumar
(74) *Attorney, Agent, or Firm* — Carrier Blackman & Associates, P.C.; Joseph P. Carrier; William D. Blackman

(57) ABSTRACT

In a handle device for a vehicle door, a base member made of a synthetic resin is provided with: a pin support part having a support hole; and a pair of restricting walls which flexes so as to allow a pin to pass through when the pin is inserted into the support hole and which opposes an end part of the pin after insertion of the pin is completed. The pin is formed so as to integrally have: a pin main portion being formed in a round bar shape having a constant diameter and a circular cross-sectional shape and being inserted from one end side through the support hole; and a large diameter portion being coaxially connected to the other end of the pin main portion. The two restricting walls, which are formed in a flat plate shape, are provided on the base member so that the gap between opposing faces of the two restricting walls in a state in which no external force is acting on the restricting walls is larger than a diameter of the pin main portion and smaller than the maximum diameter of the large diameter portion. Accordingly, it is possible to achieve the assemblability of the pin to be enhanced and molding of the base member to be made easy, thus reducing the number of operating steps.

1 Claim, 5 Drawing Sheets

HANDLE DEVICE FOR VEHICLE DOOR

CROSS-REFERENCE TO RELATED APPLICATIONS

The present application claims priority under 35 USC 119 to Japanese Patent Application Nos. 2009-233260 filed on Oct. 7, 2009 the entire contents of which are hereby incorporated by reference.

BACKGROUND OF THE INVENTION

1. Field of the Invention

The present invention relates to a handle device for a vehicle door comprising: a base member made of a synthetic resin mounted on a door of a vehicle; a pin support part provided on the base member and having a support hole for a pin pivotably supporting a handle on the base member to be inserted through; and a pair of restricting walls provided on the base member and disposed at a position spaced toward the rear of the pin support part in a direction in which the pin is inserted into and assembled with the support hole so that the restricting walls flex so as to allow the pin to pass through when the pin is inserted into the support hole and oppose an end part of the pin so as to prevent the pin from falling out of the pin support part after insertion of the pin through the support hole is completed.

2. Description of the Related Art

Such a handle device is known from Japanese Patent Application Laid-open No. 9-78897; in this arrangement a round bar-shaped pin having a constant diameter along the entire length is inserted through a bracket, and a claw portion opposing an end part of the pin inserted through the bracket is provided on each of a pair of restricting walls.

In the handle device disclosed by Japanese Patent Application Laid-open No. 9-78897, when assembly is carried out by inserting the pin into the bracket, the operation of inserting the pin through must be carried out while the outer peripheral face, along the entire length in the axial direction, of the pin is in sliding contact with the claw portions of the pair of restricting walls, thereby producing a frictional force between the pin and the claw portions, and since the pin must be inserted with a force that exceeds the frictional force, it cannot be said that the assemblability of the pin is excellent. Moreover, the restricting walls are provided with the claw portions, and it is necessary to enhance the dimensional accuracy between the claw portions of the two restricting walls when molding the bracket, thereby increasing the number of operating steps.

SUMMARY OF THE INVENTION

The present invention has been accomplished in light of such circumstances, and it is an object thereof to provide a handle device for a vehicle door that enables the assemblability of a pin to be enhanced and molding of a base member to be made easy, thus reducing the number of operating steps.

In order to achieve the object, according to a first feature of the present invention, there is provided a handle device for a vehicle door comprising: a base member made of a synthetic resin mounted on a door of a vehicle; a pin support part provided on the base member and having a support hole for a pin pivotably supporting a handle on the base member to be inserted through; and a pair of restricting walls provided on the base member and disposed at a position spaced toward the rear of the pin support part in a direction in which the pin is inserted into and assembled with the support hole so that the restricting walls flex so as to allow the pin to pass through when the pin is inserted into the support hole and oppose an end part of the pin so as to prevent the pin from falling out of the pin support part after insertion of the pin through the support hole is completed, wherein the pin is formed so as to integrally have a pin main portion and a large diameter portion, the pin main portion being formed in a round bar shape having a constant diameter and a circular cross-sectional shape and being inserted from one end side through the second support hole, and the large diameter portion having a larger diameter than the pin main portion and being coaxially connected to the other end of the pin main portion, and the two restricting walls, which are formed in a flat plate shape, are provided on the base member so that a gap between opposing faces of the two restricting walls in a state in which no external force is acting on the restricting walls is larger than the diameter of the pin main portion and smaller than the maximum diameter of the large diameter portion.

In accordance with the first feature of the present invention, since the pin integrally has the pin main portion that is inserted from one end side through the support hole of the pin support part and the large diameter portion having a larger diameter than the pin main portion and coaxially connected to the other end of the pin main portion, and the gap between the opposing faces of the pair of restricting walls formed in a flat plate shape is larger than the diameter of the pin main portion in a state in which an external force is not acting on the restricting walls and is smaller than the maximum diameter of the large diameter portion, there is no frictional resistance, or if there is it is very small, when the pin main portion passes between the two restricting walls during insertion and assembly of the pin, thus enhancing the assemblability of the pin. Furthermore, frictional resistance occurs when the large diameter portion of the pin passes between the two restricting walls, and this can impart a restraining feel to insertion and assembly operations of the pin, thus improving the reliability of assembly of the pin. Moreover, since the pair of restricting walls have a flat plate shape, molding of the base member becomes easy, and the number of operating steps can be reduced.

According to a second feature of the present invention, in addition to the first feature, a tapered face is formed on an outer periphery, at least on the pin main portion side, of the large diameter portion, the tapered face having a diameter that decreases in going toward the pin main portion side.

In accordance with the second feature of the present invention, since the tapered face is formed on the outer periphery, on at least the pin main portion side, of the large diameter portion, when the large diameter portion passes between the pair of restricting walls, the large diameter portion can be passed through while the tapered face of the large diameter portion makes the two restricting walls gradually flex, thus enabling insertion and assembly of the pin to be carried out more smoothly.

Here, a second pin support part 19 of an embodiment corresponds to the pin support part of the present invention; and a second support hole 28 of the embodiment corresponds to the support hole of the present invention.

The above description, other objects, characteristics and advantages of the present invention will be clear from detailed descriptions which will be provided for the preferred embodiment referring to the attached drawings.

DESCRIPTION OF THE PREFERRED EMBODIMENT

Hereinafter, an embodiment of the present invention is explained by reference to the attached FIG. 1 to FIG. 5. First, in FIG. 1 and FIG. 2, a door 11, which is a rear side door of a vehicle V that is for example a passenger vehicle, is provided with a window glass 12 that can be raised and lowered, a base member 13 made of a synthetic resin so as to be connected to a rear part of the window glass 12 at the maximum limit of the raised position is mounted on the door 11, and a handle 14 for opening the door 11 is pivotably supported on the base member 13.

Figure 1:
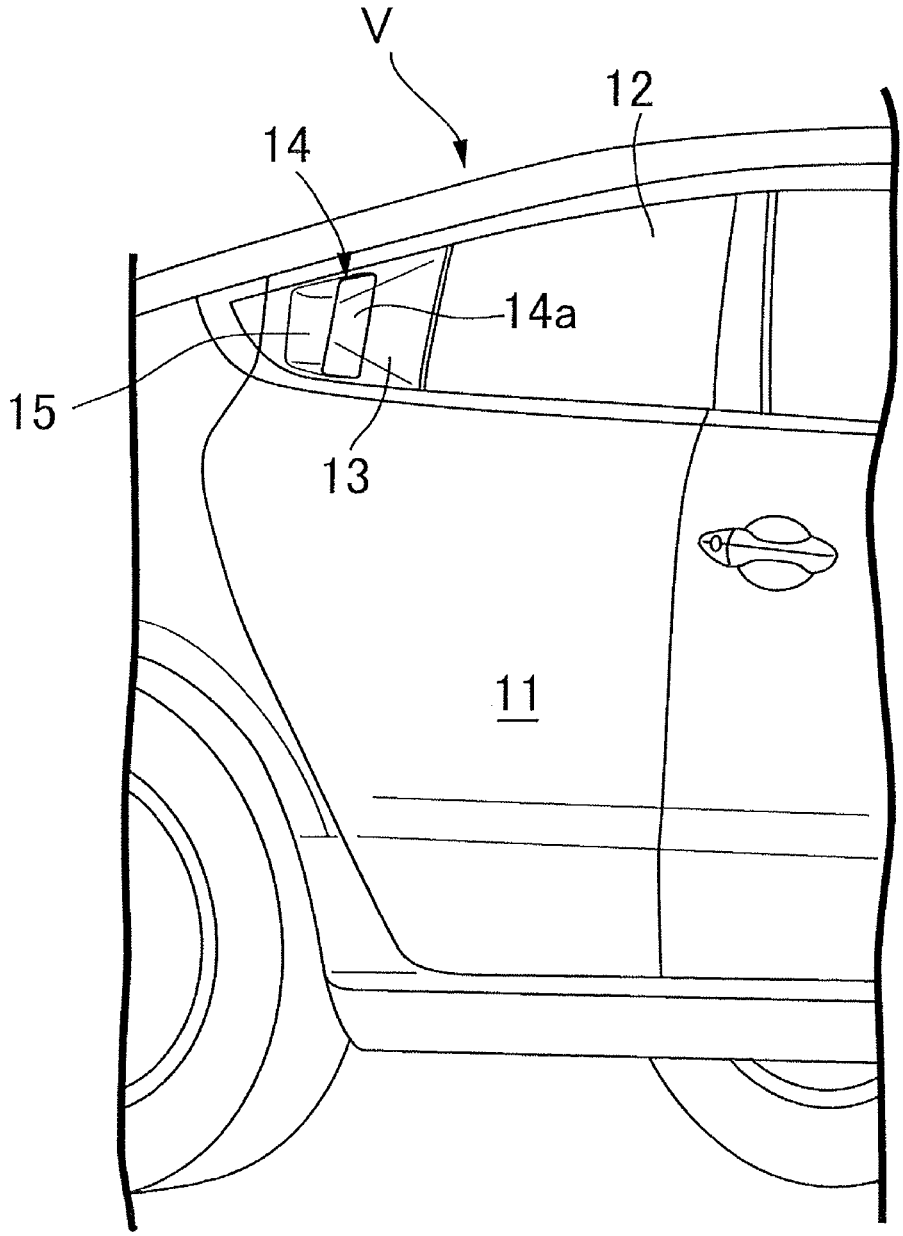
FIG. 1 is a side view of a portion of a vehicle with a handle device being assembled.
Figure 2:
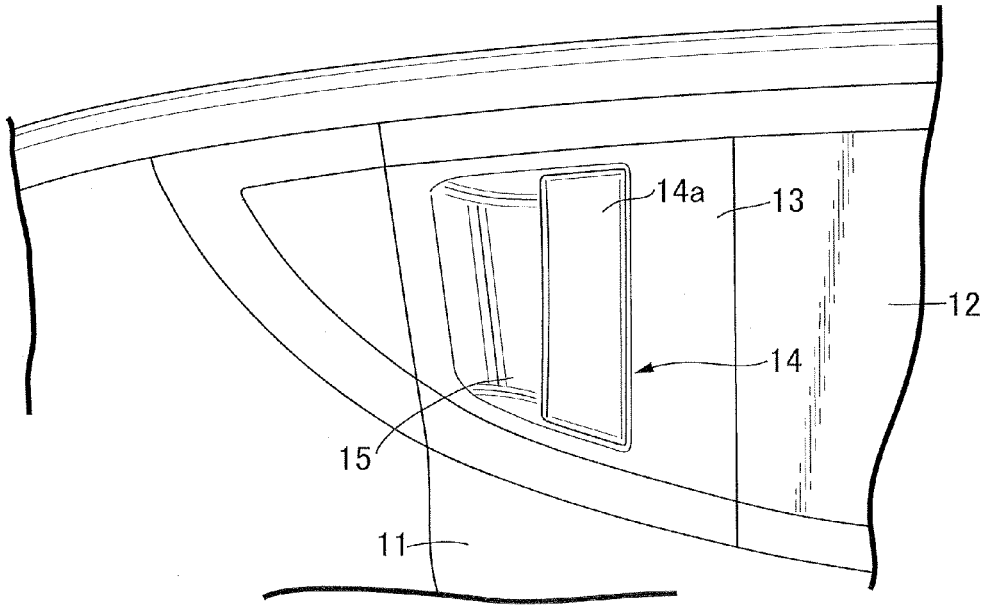
FIG. 2 is an enlarged view of an essential part in FIG. 1.
Figure 3:
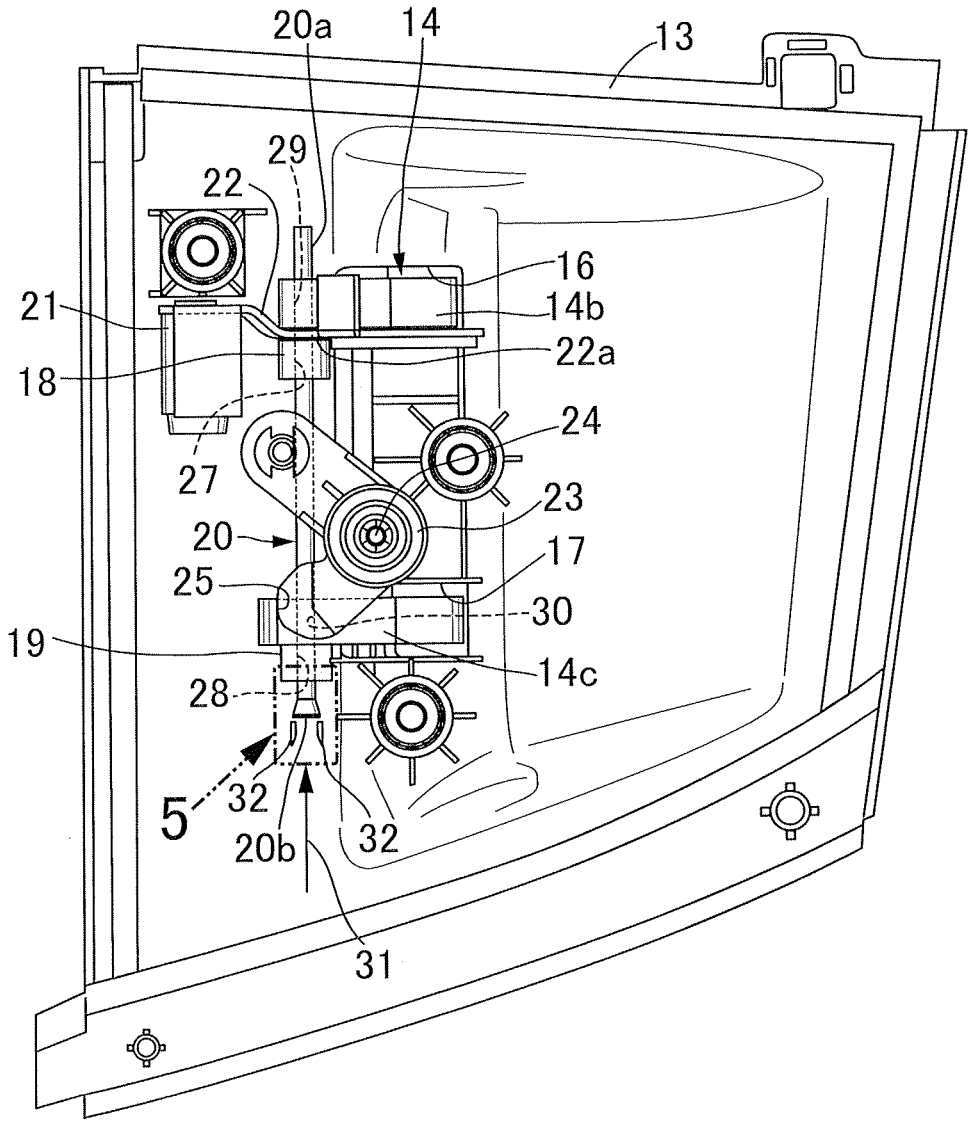
FIG. 3 is a back view of a base member.
Figure 4:
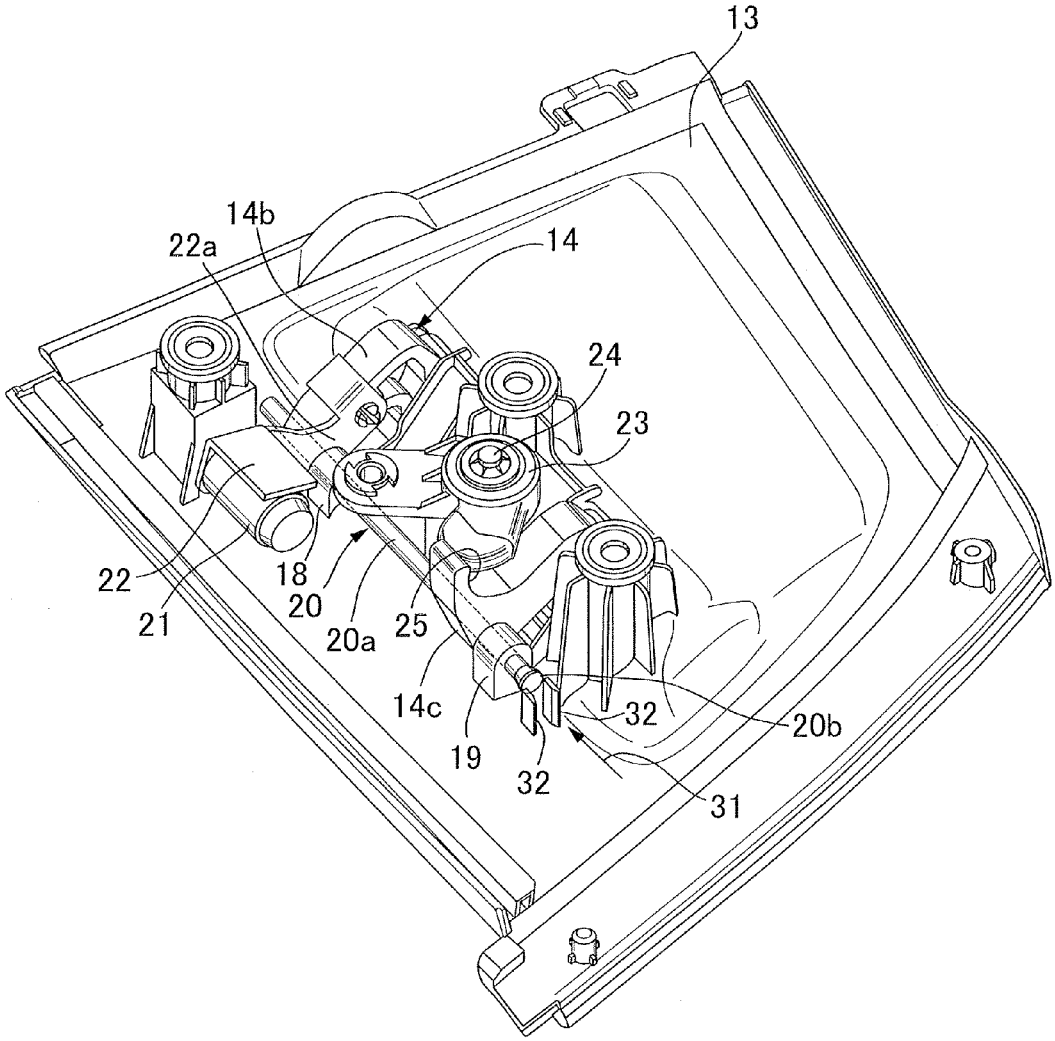
FIG. 4 is a perspective view, seen from the back side, of the base member.

Referring to FIG. 3 and FIG. 4 together, the handle 14 integrally has a vertically extending grip portion 14*a*, a first arm portion 14*b* connected to an upper part of the grip portion 14*a*, and a second arm portion 14*c* connected to a lower part of the grip portion 14*a*, and in a non-operational state of the handle 14 the grip portion 14*a* is housed and disposed in a recess 15 provided on the front face side of the base member 13. Furthermore, the base member 13 is provided with openings 16 and 17 opening in an upper part and a lower part of the recess 15, and the first and second arm portions 14*b* and 14*c* are inserted from these openings 16 and 17 into the back face side of the base member 13.

The first and second arm portions 14*b* and 14*c* are pivotably supported via a vertically extending pin 20 on first and second pin support parts 18 and 19 provided integrally with the back face of the base member 13, the first pin support part 18 being disposed beneath the first arm portion 14*b*, and the second pin support part 19 being disposed beneath the second arm portion 14*c* so as to be in sliding contact with the lower part of the second arm portion 14*c*.

Furthermore, one end part of a counterweight bracket 22 supporting a counterweight 21 is mounted on the first arm portion 14*b* on the back face side of the base member 13, and a flat plate portion 22*a* that is present on one end side of the counterweight bracket 22 is disposed between the first arm portion 14*b* and the first pin support part 18. Moreover, a middle part of a lever 23 that has a substantially L-shaped form is pivotably supported via a support shaft 24 on the back face of the base member 13 between the first and second arm portions 14*b* and 14*c*, an abutment face 25 abutting against one end part of the lever 23 is formed on a tip end of the second arm portion 14*c*, and a rod (not illustrated) linked to a door lock device is linked to the other end part of the lever 23. By pivoting the handle 14 a force that makes the lever 23 pivot in the anti-clockwise direction in FIG. 3 acts on the lever 23 from the abutment face 25, thereby making a pressing force from the lever 23 act on the rod.

A return spring (not illustrated), which is a torsion spring surrounding the support shaft 24, is provided between the lever 23 and the base member 13, one end part of the lever 23 abuts against the abutment face 25 of the second arm portion 14*c* of the handle 14 by virtue of a spring force exhibited by the return spring, and a spring force toward the return side acts on the handle 14.

The first pin support part 18 is provided with a first support hole 27 for the pin 20 to be inserted through, and the second pin support part 19 is provided with a second support hole 28 for the pin 20 to be inserted through, the second support hole 28 being coaxial with the first support hole 27. Furthermore, the first arm portion 14*b* and the second arm portion 14*c* of the handle 14 are provided with through holes 29 and 30 (see FIG. 3) so that the pin 20 is inserted therethrough, the through holes 29 and 30 being coaxial with the first and second support holes 27 and 28.

The pin 20 is inserted from the second support hole 28 side in sequence through the second support hole 28, the through hole 30, the first support hole 27, and the through hole 29 in a state in which the through holes 29 and 30 of the first and second arm portions 14*b* and 14*c* of the handle 14 are coaxial with the first and second support holes 27 and 28 of the first and second pin support parts 18 and 19, and a pair of restricting walls 32 and 32 provided integrally with the back face of the base member 13 are disposed at positions spaced on the rear side of the second pin support part 19 (the lower side in this embodiment) in an insertion/assembly direction 31 for the pin 20. These restricting walls 32 and 32 flex so as to allow the pin 20 to pass through when the pin 20 is inserted into the second support hole 28, the through hole 30, the first support hole 27, and the through hole 29, and oppose an end part, on the restricting walls 32 side, of the pin 20 in order to prevent it from falling out of the first and second pin support parts 18 and 19 after insertion thereof through the second support hole 28, the through hole 30, the first support hole 27, and the through hole 29 is completed.

Referring in addition to FIG. 5, the pin 20 is formed so as to integrally have a pin main portion 20*a* and a large diameter portion 20*b*, the pin main portion 20*a* being formed in a round bar shape having a constant diameter d2 and a circular cross-sectional shape and being inserted through the second support hole 28, the through hole 30, the first support hole 27, and the through hole 29 from one end side, and the large diameter portion 20*b* having a larger diameter than the pin main portion 20*a* and being coaxially connected to the other end of the pin main portion 20*a*. The two restricting walls 32 and 32 are formed in a flat plate shape, a gap d1 between opposing faces of the two restricting walls 32 in a state in which no external force acts on these restricting walls 32 is set so as to be larger than the diameter d2 of the pin main portion 20*a* and smaller than a maximum diameter d3 of the large diameter portion 20*b*.

Moreover, a tapered face 33 is formed on the outer periphery, on at least the pin main portion 20*a* side, of the large diameter portion 20*b*, in this embodiment the outer periphery, on the pin main portion 20*a* side, of the large diameter portion 20*b*, the tapered face 33 having a diameter that decreases in going toward the pin main portion 20*a* side. Furthermore, guide faces 34 and 34 are formed in portions, on the rear side along the insertion/assembly direction 31, of the opposing faces of the two restricting walls 32 and 32, the guide faces 34 and 34 being inclined so that they become closer to each other in going toward the front along the insertion/assembly direction 31.

Figure 5C:
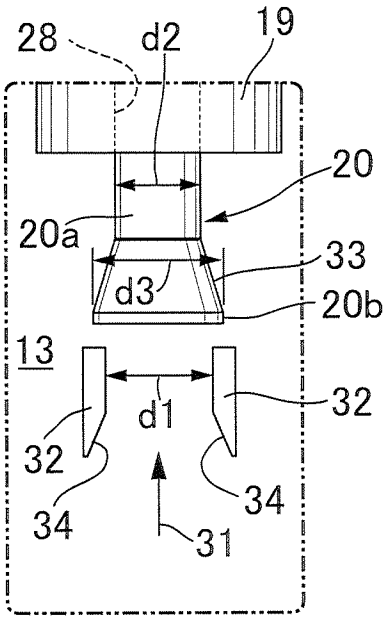
FIG. 5A to 5C are enlarged views showing a part indicated by an arrow 5 in FIG. 3 in a process order of inserting and assembling a pin.
Figure 5B:
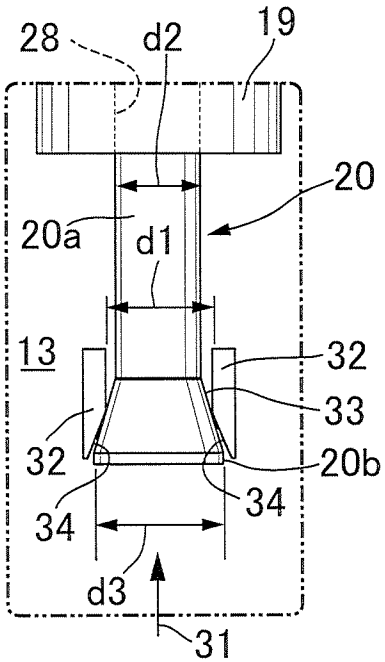
Figure 5A:
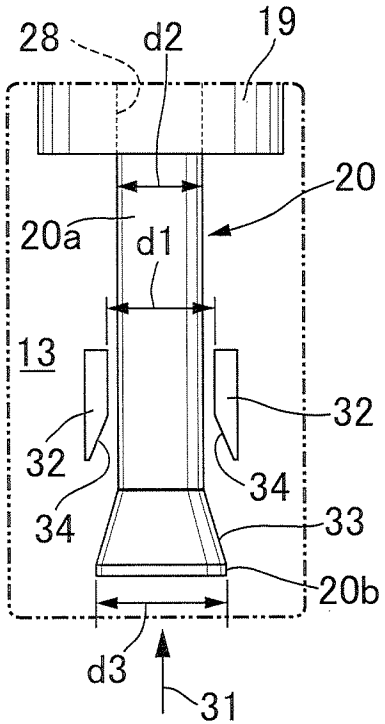

When the pin 20 is inserted via one end side of the pin main portion 20*a* through the second support hole 28, the through hole 30, the first support hole 27, and the through hole 29, after the pin main portion 20*a* passes between the two restricting walls 32 as shown in FIG. 5A, as shown in FIG. 5B the large diameter portion 20*b* of the pin 20 abuts against the two restricting walls 32 and the pin 20 continues to be pushed forward along the insertion/assembly direction 31, the large diameter portion 20*b* is thereby guided by the guide faces 34, projects between the two restricting walls 32, and passes between the two restricting walls 32 while making the two restricting walls 32 flex so as to enlarge the gap between the two restricting walls 32; after the large diameter portion 20*b* passes between the two restricting walls 32, as shown in FIG. 5C the two restricting walls 32 oppose the large diameter portion 20*b*, which is an end part, on the restricting walls 32 side, of the pin 20, thereby preventing the pin 20 from falling out of the second pin support part 19.

In order to prevent rattling of the pin 20 in the longitudinal direction, one end part of the pin 20 projecting from the first arm portion 14*b* of the handle 14 may be processed so as to be flattened so that the flattened part abuts against and engages with an upper part of the first arm portion 14*b*.

The operation of this embodiment is now explained. The pin 20 is formed so as to integrally have the pin main portion 20*a* and the large diameter portion 20*b*, the pin main portion 20*a* being formed in a round bar shape having the constant diameter d2 and a circular cross-sectional shape and being inserted from one end side through the second support hole 28 of the second pin support part 19, and the large diameter portion 20*b* having a larger diameter than the pin main portion 20*a* and being coaxially connected to the other end of the pin main portion 20*a*, and the pair of restricting walls 32 and 32, which are formed in a flat plate shape, are provided on the base member 13 so that the gap d1 between the opposing faces of the two restricting walls 32 in a state in which no external force acts on these restricting walls 32 is larger than the diameter d2 of the pin main portion 20*a* and smaller than the maximum diameter d3 of the large diameter portion 20*b*.

Therefore, there is no frictional resistance, or if there is it is very small, when the pin main portion 20*a* passes between the two restricting walls 32 during insertion and assembly of the pin 20, thus enhancing the assemblability of the pin 20. Furthermore, frictional resistance occurs when the large diameter portion 20*b* of the pin 20 passes between the two restricting walls 32, and this can impart a restraining feel to insertion and assembly operations of the pin 20, thus improving the reliability of assembly of the pin 20. Moreover, since the pair of restricting walls 32 have a flat plate shape, molding of the base member 13 becomes easy, and the number of operating steps can be reduced.

Furthermore, since the tapered face 33 is formed on the outer periphery, on at least the pin main portion 20*a* side, of the large diameter portion 20*b*, when the large diameter portion 20*b* passes between the pair of restricting walls 32, the large diameter portion 20*b* can be passed through while the tapered face 33 of the large diameter portion 20*b* makes the two restricting walls 32 gradually flex, thus enabling insertion and assembly of the pin 20 to be carried out more smoothly.

An embodiment of the present invention is explained above, but the present invention is not limited to the above-mentioned embodiment and may be modified in a variety of ways as long as the modifications do not depart from the gist of the present invention.

What is claimed is:

1. A handle device for a vehicle door comprising:

a base member made of a synthetic resin mounted on a door of a vehicle;

a pair of pin support parts, including a first pin support part and a second pin support part, integrally provided on the base member and each first and second pin support parts having a support hole for a pin pivotably supporting a handle on the base member to be inserted through; and a pair of restricting walls integrally provided on the base member and disposed at a position spaced toward an insertion side of a second pin support part in an insertion and assembly direction in which the pin is inserted into and assembled with the support holes so that the restricting walls flex so as to allow the pin to pass through when the pin is inserted into the support holes and oppose an end part of the pin so as to prevent the pin from falling out of the pair of pin support parts after insertion of the pin through the support holes is completed, wherein the pin is formed so as to integrally have a pin main portion and a large diameter portion, the pin main portion being formed in a round bar shape having a constant diameter and a circular cross-sectional shape and being inserted from one end side through the support hole of the second pin support part, and the large diameter portion having a larger diameter than the pin main portion and being coaxially connected to the other end of the pin main portion, a tapered face being formed on an outer periphery, on at least the pin main portion side, of the large diameter portion, the tapered face having a diameter that decreases going toward the pin main portion side, the two restricting walls, which are formed in a flat plate shape, are provided on the base member so that mutually opposing faces of the two restricting walls are formed to extend parallel to an axis of the support holes and that a gap between the opposing faces of the two restricting walls in a state in which no external force is acting on the restricting walls is larger than the diameter of the pin main portion and smaller than the maximum diameter of the large diameter portion, and wherein end faces of the two restricting walls on a front side in the insertion and assembly direction and end faces of the large diameter portion on a rear side in the insertion and assembly direction are respectively formed flat in a direction perpendicular to the axis of the support holes, and guide faces are formed respectively on end portions of the opposing faces of the restricting walls, which guide faces are distanced gradually from each other going toward the rear along the insertion and assembly direction so as to guide the large diameter portion of the pin to project into a position between the restricting walls, and wherein when the pin is configured to be inserted into the hole, such that the large diameter portion passes between the two restricting walls after the pin main portion has passed between the restricting walls and only when the large diameter portion passes between the restricting walls, the restricting walls are configured to flex toward an open side, and after the large diameter portion has passed between the restricting walls, the restricting walls are configured to return to the state in which no external force is acting on the restricting walls and said end faces of the larger diameter portion and said end faces of the restricting walls oppose each other.

* * * * *